United States Patent [19]

Frantzreb, Sr.

[11] 4,053,120

[45] Oct. 11, 1977

[54] WIRE REEL

[75] Inventor: John G. Frantzreb, Sr., Peoria, Ill.

[73] Assignee: Caterpillar Tractor Co., Peoria, Ill.

[21] Appl. No.: 649,873

[22] Filed: Jan. 16, 1976

[51] Int. Cl.[2] ..... B65H 75/22

[52] U.S. Cl. ..... 242/115; 242/77/2; 242/118.4; 242/118.7

[58] Field of Search ..... 242/115, 129, 72, 118.8, 242/118.7, 118.4, 77, 71.8, 118.61, 77.3, 71.9, 73, 77.2

[56] References Cited

U.S. PATENT DOCUMENTS

| | | | |
|---|---|---|---|
| 1,105,028 | 7/1914 | Gill | 242/77.2 |
| 1,591,771 | 7/1926 | Batchelor | 242/115 |
| 1,767,710 | 6/1930 | Smith | 242/115 |
| 1,946,764 | 2/1934 | Schaub | 242/77.2 |
| 3,203,453 | 8/1965 | McConnell | 242/115 X |
| 3,524,604 | 8/1970 | Morris | 242/115 |

*Primary Examiner*—George F. Mautz
*Attorney, Agent, or Firm*—Phillips, Moore, Weissenberger, Lempio & Majestic

[57] ABSTRACT

A wire reel on which wire of various sorts may be wound includes a peripherally separable core and two side pieces formed of wire and removably associated with a core. The side pieces, removably retained on the core by a keeper demountably affixed thereto define a plurality of projections extending outwardly from the core to form a spoked spool so that wire may be wound upon the core between the side pieces.

4 Claims, 7 Drawing Figures

WIRE REEL

BACKGROUND OF THE INVENTION

Manufacturers of wire, of necessity, have found packaging the finished product to be particularly important from the standpoint of the end user. Furthermore, the packaging is important to the manufacturer to reduce costs and time in preparing the product for shipment. Wire is normally shipped in a coil form and in many applications is shipped on a core support to facilitate use by the consumer. Particular applications require core wound coiled wire to be installed on a machine where the wire is drawn off for use in a subsequent manufacturing product process.

Present packaging of wire reels of a core support, particularly cardboard core supports, requires the use of four of five tie bands wound about the finished coil of wire. The use of wire tie bands in the packaging of wire coils requires additional labor by the packager or manufacturer of the wire to place the bands on the coil, and also requires additional time of the consumer to remove the ties. Further, the tie bands are expended thus increasing costs.

The time expended in placing tie bands about a coil of wire and removing the tie bands may be avoided by the use of reels with end pieces to form a spool which permit the packager to affix the start and the end of the wire to the reel structure itself. Such spool type reels eliminate the need for wire tie bands; however, these reels are initially more expensive and if reused to lower the cost, require a great deal of waste space in storage.

Accordingly, this invention is a wire reel which is in spool like form to overcome the disabilities of tie retained wire reels and has core side pieces which may be disassociated from the core of the reel to reduce storage requirements both before use and after use. The unique design of the wire reel disclosed herein allows the packager of wire to assemble the components by hand at the time winding. Placing the assembled reel on the wire winding machine with its outwardly extending projections permits bending the start and the end of the wire wound on the reel around one of the projections to retain the wire on the reel. The user is not burdened by wire tie bands and upon expenditure of all the wire wound on the reel, the user may disassemble the reel for reuse.

SUMMARY OF THE INVENTION

It is an object of this invention to provide a wire reel which does not require wire tie bands to retain wire wound thereupon.

It is a further object of this invention to provide a wire reel which fulfills the above object, and may be assembled at the time the wire is to be wound upon the reel.

It is a further object of this invention to provide a wire reel which fulfills the above objectives, and which may be disassembled and reused.

Briefly stated, the invention is a wire reel comprising a peripherally separable annular core, to which side means are removably associated to form a spool. The side means are retained on the peripherally separable annular core by keeper means demountably affixed to the annular core.

These and other objects of this invention will become apparent from a study of the accompanying drawings and following specification.

DETAILED DESCRIPTION

Figure 1:
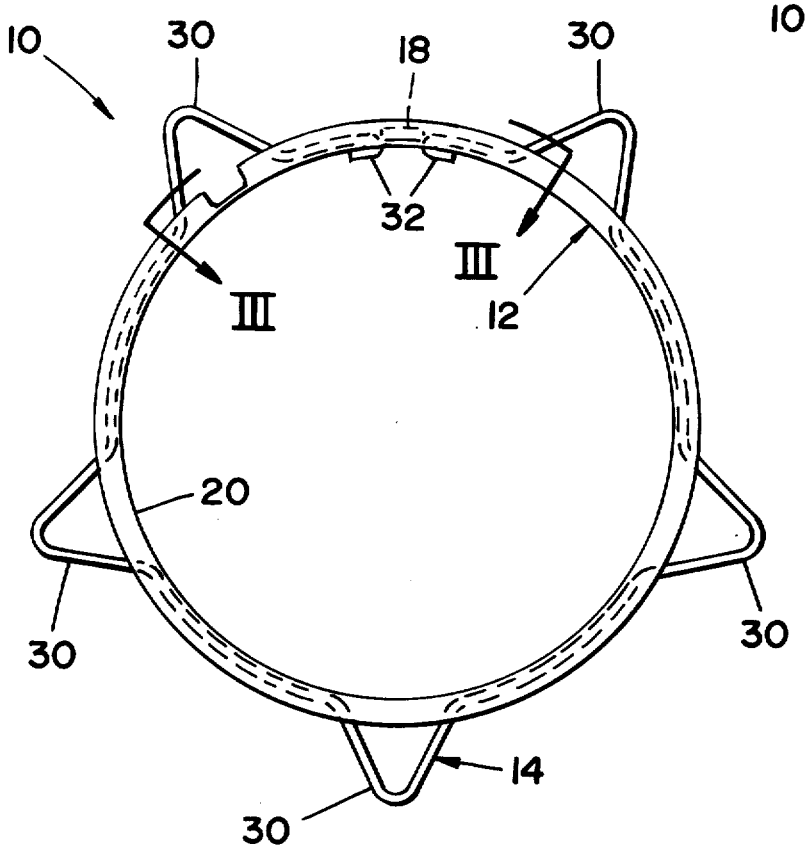
FIG. 1 is an elevation view of the assembled wire reel which is the subject of this invention.
Figure 2:
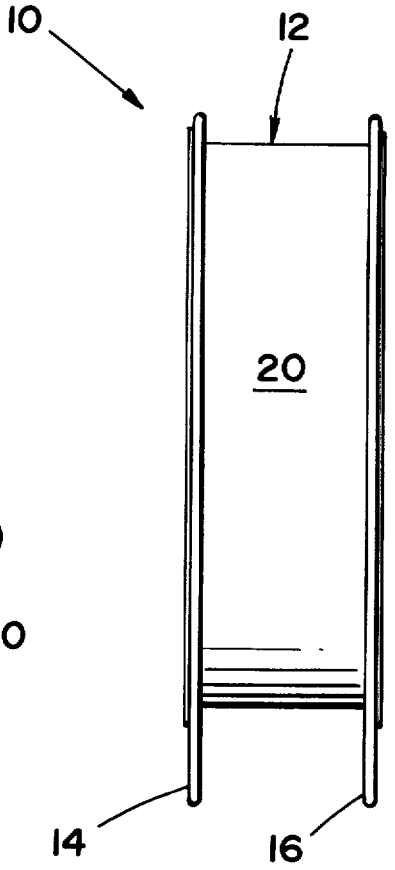
FIG. 2 is an end elevation view of the wire reel shown in FIG. 1.

A fully assembled wire reel 10 in accordance with this invention is illustrated in FIG. 1. The reel is comprised of an annular core 12 which is peripherally separable as will become clear in the following discussion. Side means comprised of first side piece 14 and a second side piece 16 are removably associated with annular core 12 to form a spool so that wire may be wound thereon. A keeper 18 is demountably affixed to annular core 12 to spatially separate and retain the side pieces thereupon.

Figure 3:
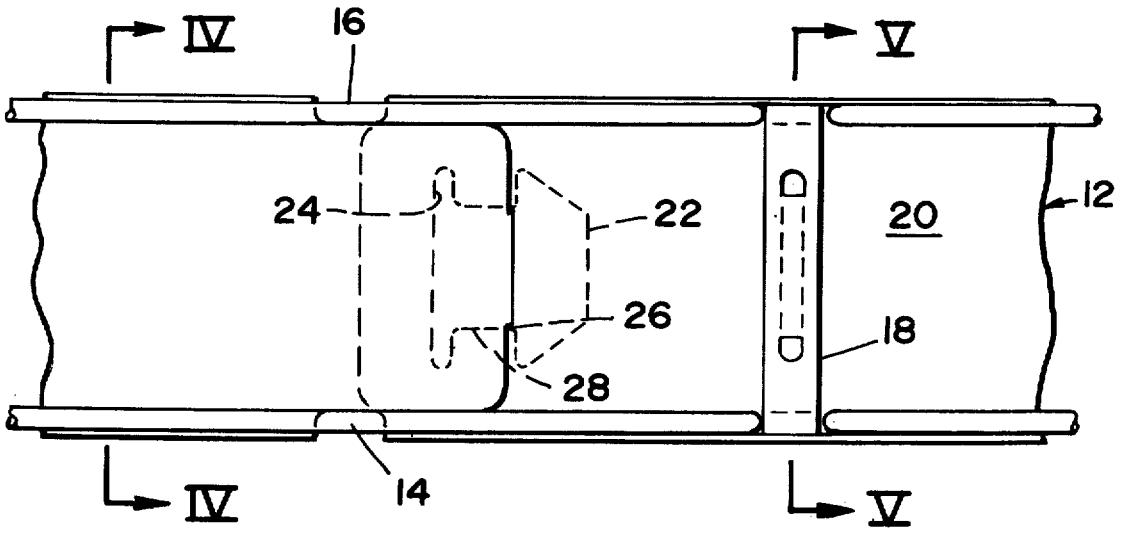
FIG. 3 is a detailed view of the coupling means interconnecting the core member of the wire reel shown in FIG. 1 taken at section line III—III of FIG. 1.

Annular core 12, which is peripherally separable, is comprised of an elongated member 20 formed generally in a collar shape with a lock tab 22 formed at one end and a T-shaped slot 24 defined at the other opposite end of the elongated member to form a lock means for coupling the ends of the elongated member and form the peripherally separable annular core. The T-shaped slot is oriented with the cross portion of the T transverse of the elongated member and proximate the end. The lock tab, which is receivable in the T-shaped slot, is shaped in the form of a trapezoid having a neck 26 affixing the longer of the two parallel-sides of the lock tab to the elongated member, so that when the lock tab overlaps the opposite end of the elongated member and is received in T-shaped slot 24 with the lock tab interior of the formed cylinder, neck 26 may slide downwardly in leg 28 of the T-shaped slot. Referring to FIG. 3, the lock tab is shown received in the T-shaped slot with neck 26 so disposed in leg 28.

First side piece 14 and second side piece 16 are identical in construction; therefore, a description of the structure of first side piece 14 will suffice for the structure of the second side piece 16. First side piece 14 may be formed of wire having sufficient size to readily retain its formed shape under use with the wire which will be wound upon the assembled wire reel. Side piece 14 defines a plurality of bights 30, which, then assembled with elongated member 20, extend outwardly therefrom. The side piece also defines at each end a hook 32, the purpose of which will become apparent in the later discussion.

Figure 4:
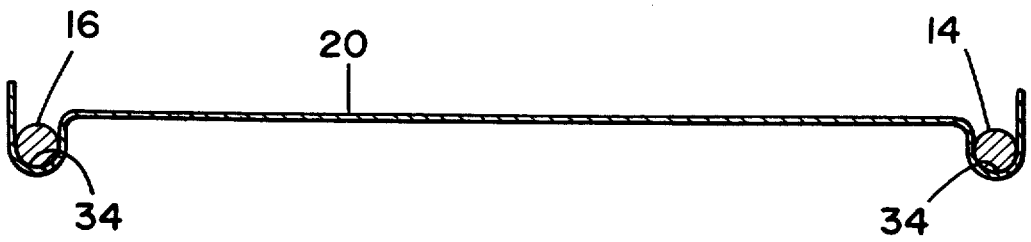
FIG. 4 is a cross sectional view of the wire reel shown in FIG. 1 taken at line IV—IV of FIG. 3.
Figure 5:
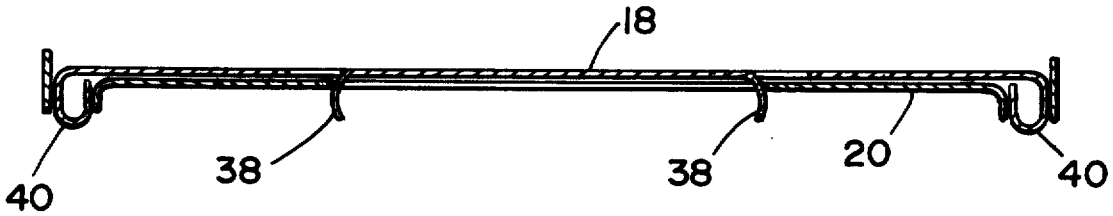
FIG. 5 is a cross sectional view of the same wire reel taken at section line V—V of FIG. 3 and illustrates the keeper.
Figure 6:
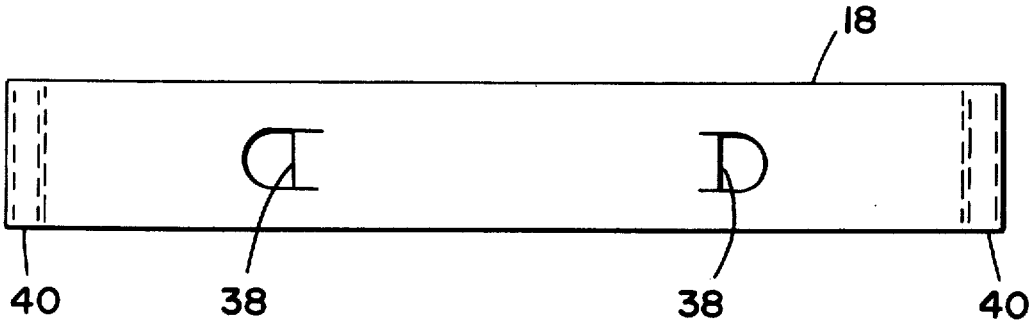
FIG. 6 is a plan view of the keeper shown in FIG. 5.
Figure 7:
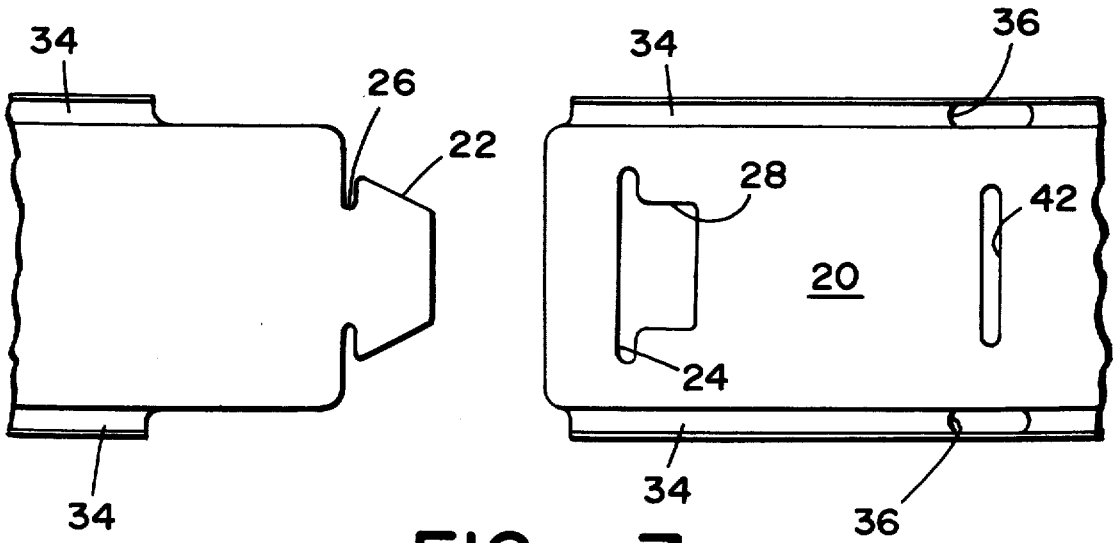
FIG. 7 shows the disengaged coupling shown in FIG. 3.

Elongated member 20, shown in cross section in FIG. 4, has unitarily formed therewith along each side, U-shaped channels 34 of sufficient depth to receive first side piece 14 and second side piece 16 respectively. Each channel 34 terminates short of the ends of elongated member 20 so that when the ends of the elongated member are overlapped and coupled by the lock means, channel 34 forms a continuous groove around the formed annular core. In particular, at the lock tab end of elongated member 20, channel 34 is terminated at a distance from the end relatively the same that T-shaped slot 24 is positioned in from the other end of elongated member 20 while the same channel at the end adjacent the T-shaped slot terminates proximate the end. Each U-shaped channel 34 is pierced in the lower portion thereof by a hole 36 proximate a slot 42 transversely oriented to the longitudinal axis of the elongated member, the purpose of which will become apparent. Hook shaped ends 32 of first side piece 14, and the corresponding hooked shaped ends 32 of the second side piece 16 are received in holes 36 when the side pieces are disposed in channels 34 to form the spool-like reel.

In order to retain side piece 14 and side piece 16 in channels 34, keeper 18 is adapted to be demountable affixed to elongated member 20 in a slot 42. The keeper is unitarily formed with two spatially separated downwardly projecting spring tabs 38 which when received in slot 42 spring outwardly in order to retain the keeper in close proximity to the elongated member. The keeper also has integrally formed at each end downwardly extending J-shaped projections 40 hooked back under the keeper, each adapted to separate the hooked ends 32 of respective side piece 14 and 16. Keeper 18, in maintaining the hooked ends in this spatially separated state, serves to prevent removal of side pieces 14 and 16 from the elongated member, while after wire has been wound on the reel, keeper 18 itself cannot be removed.

Elongated member 20, as shown in FIG. 1, is in a cylindrical or collar shape. Because of channels 34 being circumferentially oriented around the long sides of the elongated member; once formed, elongated member 20 retains its generally cylindrical or collar-like shape even through lock tab 22 is not disposed in T-shaped slot 24. This collar-like form can facilitate storage of the disassembled wire reel. In order to assemble the wire reel, lock tab 22 may be overlapped of the T-shaped slot end of the elongated member 20 and disposed in T-shaped slot 24. Side pieces 14 and 16 are then led around channels 34 with the hooked shaped end 32 at the opposite end of each side piece disposed in holes 36 proximate slot 42 in elongated member 20. With the two side pieces each disposed in channels 34 on opposite sides of the elongated member, keeper 18 is affixed in slot 42 by means of tabs 38 with J-shaped ends 40 separating opposite hooked ends 32 of each side pieces 14 and 16 to complete the assembly. The wire reel may then be placed on a wire winding machine, and the wire to be wound thereupon may be started by bending an end about a bight 30. When the wire winding process is complete, the end of the wire wound upon wire reel 10 may be similarly led through a bight and twisted thereabout. The user of wire wound on wire reel 10 after the wire is expended therefrom, may disassemble the reel for reuse. The unique collar shaped arrangement of elongated member 20 while disassembled allows stacking of numerous collar shaped pieces thereby saving space. The side pieces 14 and 16 may similarly be grouped together.

Although this invention has been described with a degree of particularity, it is to be understood that variations may be accomplished while remaining within the scope of the

What is claimed is:

1. A wire reel comprising:

an elongated member including lock means unitarily formed at the ends thereof for coupling said ends of said elongated member one to the other to form an annular core, said elongated member having unitarily formed along each elongated side a U-shaped channel;

first and second side pieces each removably received in the U-shaped channel with said elongated member formed in an annular core to form a reel therewith, each side piece defining a plurality of projections, extending radially outwardly from said elongated member while said elongated member is formed in an annular core;

keeper means demountably affixed to said elongated member while formed in an annular core, said keeper means acting in cooperation with said side pieces for retaining said side pieces in a fixed relation relative said core.

2. The wire reel set forth in claim 1 wherein each side piece comprises a formed wire member having hooked shaped ends and wherein each projection comprises an upstanding bight thereof; and further wherein the elongated member defines a hole in each U-shaped channel;

each said formed wire member disposed in a U-shaped channel of the elongated member with said hooked shaped ends received in said holes while said formed wire member is associated with the elongated member.

3. The wire reel set forth in claim 2 wherein the elongated member defines a slot transverse of the longitudinal axis thereof, and further wherein the holes defined in the channels are positioned proximate said slot;

and wherein said keeper means comprises a keeper member having a pair of lock tabs adapted to be received in said slot extending outwardly therefrom, spatially separated a distance substantially equal to the length of said slot and having resilient properties to retain said keeper in close proximity of said elongated member while said tabs are received in said slot;

said keeper further defining at each end thereof downwardly extending projections adapted to be received in said holes of the elongated member to separate the hook shaped ends of the formed wire members, whereby removal of the formed wire members is precluded without removal of the keeper.

4. The wire reel set forth in claim 3 wherein the lock means comprises a lock tab unitarily formed at one end of the elongated member, and a T-shaped slot defined at the other opposite end of said elongated member, whereby said lock tab is receivable in said T-shaped slot to establish the continuous annular core.

* * * * *